US005947206A

United States Patent [19]

McCalvin et al.

[11] Patent Number: 5,947,206

[45] Date of Patent: Sep. 7, 1999

[54] DEEP-SET ANNULUS VENT VALVE

[75] Inventors: David E. McCalvin, Sugar Land, Tex.; Gregory B. Stephenson, Broussard, La.; Dwayne E. May, Humble, Tex.

[73] Assignee: Camco International Inc., Houston, Tex.

[21] Appl. No.: 08/977,778

[22] Filed: Nov. 25, 1997

[51] Int. Cl.[6] ..... E21B 33/00

[52] U.S. Cl. ..... 166/324; 166/321

[58] Field of Search ..... 166/321, 324, 166/332.8, 106, 322

[56] References Cited

U.S. PATENT DOCUMENTS

| | | | |
|---|---|---|---|
| 3,897,822 | 8/1975 | Mott . | |
| 4,111,608 | 9/1978 | Elliott, et al. . | |
| 4,252,197 | 2/1981 | Pringle . | |
| 4,589,482 | 5/1986 | Bayh, III . | |
| 4,621,695 | 11/1986 | Pringle . | |
| 4,660,646 | 4/1987 | Blizzard . | |
| 4,676,307 | 6/1987 | Pringle | 166/322 |
| 4,791,991 | 12/1988 | Morris et al. . | |
| 4,976,317 | 12/1990 | Leismer . | |
| 5,310,004 | 5/1994 | Leismer . | |

OTHER PUBLICATIONS

Camco Products and Services Co., CAMCO Operating Manual PGV Gas Vent Valve Pt. No. 22343–000–00000, Feb. 1991.

*Primary Examiner*—David J. Bagnell
*Assistant Examiner*—Sunil Singh
*Attorney, Agent, or Firm*—Tobor, Goldstein & Healey

[57] ABSTRACT

An annulus vent valve is provided to vent gas or other production fluids from below a packer set within a well in deep-set applications. The valve may broadly include: a body member having a first end, a second end, an outer surface, a longitudinal bore adjacent the second end, and at least one flow port extending from the longitudinal bore to the outer surface; a closure member mounted within the longitudinal bore to control fluid flow therethrough; a mechanism for biasing the closure member to a normally closed position to prevent fluid flow through the longitudinal bore; a closure member actuator disposed for movement within the longitudinal bore to open and close the closure member; a mechanism for biasing the closure member actuator away from the closure member; a piston connected to the closure member actuator and having a first end and a second end; and a gas chamber disposed within the body member and in communication with the second end of the piston.

26 Claims, 6 Drawing Sheets

DEEP-SET ANNULUS VENT VALVE

BACKGROUND OF THE INVENTION

1. Field Of The Invention

The present invention relates to devices used in hydrocarbon producing wells, and more specifically, to devices that are used for venting gas or other production fluids from below a packer to above the packer.

2. Description Of The Related Art

Completion systems are well known in the art of well production, and can take many varied forms. Well completions typically have as common elements: a casing cemented in the well extending from a surface wellhead to the producing formation; a production tubing located concentrically inside the casing; and one or more well known devices (commonly called packers) that block, pack off, and seal the annulus formed between the casing and the production tubing, generally by means of a resilient sealing element. Placement of the packer in this way directs the hydrocarbons from the producing formation into the production tubing and to the earth's surface. It is not uncommon, during the process of producing the hydrocarbons, for gas or other production fluids to accumulate in the annulus below the packer. If the amount of gas or other production fluids accumulated in the annulus below the packer becomes too excessive, the gas or other fluids can interfere with the production process. Accordingly, in those situations, it becomes desirable to remove the gas or other fluids from the annulus below the packer.

To remove the gas or other production fluids from below the packer, the packer is provided with a secondary bore therethrough, and a device (commonly referred to as an annulus vent valve) for controlling fluid flow through the secondary packer bore is connected to the upper surface of the packer and positioned across the secondary packer bore. In this manner, when an operator at the earth's surface determines that an excessive amount of gas or other fluids are building up below the packer, the annulus vent valve can be remotely actuated from the earth's surface to open the packer bore thereby permitting the gas or other fluids below the packer to be produced to the earth's surface through the annulus above the packer. By bleeding gas or other production fluids from the annulus below the packer, the hydrocarbons exiting the producing formation can be produced to the earth's surface in a more efficient manner.

There has been a recent trend in the oil and gas industry whereby companies have extended their exploration efforts into greater and greater depths. This is especially true as it relates to exploration companies venturing into water depths greater than approximately 2,000 to 3,000 feet to drill for oil and gas, such as in the Gulf of Mexico. As a result of this trend, a problem has arisen with the operation of annulus vent valves of the type described above. The problem relates to the means by which the annulus vent valve is actuated, namely, by connecting a control conduit from the earth's surface to the annulus vent valve, and then applying hydraulic fluid through the control conduit to a piston within the annulus vent valve to overcome the force of a return spring and move a flow tube to open and close a closure member, such as a flapper, which blocks or permits fluid flow from the secondary packer bore into the annulus above the packer. More particularly, the problem relates to the column of hydraulic fluid in the control conduit extending between the earth's surface and the annulus vent valve; this is sometimes referred to as the "hydrostatic head". Heretofore, it has been economically feasible to design an annulus vent valve with a return spring capable of generating sufficient force to maintain the flapper in a closed position and overcome the force of the hydrostatic head. However, as wells are drilled to deeper and deeper depths, and as packers and annulus vent valves are set at deeper and deeper depths, the length of the hydraulic control line necessarily increases, as does the force of the hydrostatic head. This requires the use of a larger and larger spring to overcome the increase in the hydrostatic head. It has been determined that, when an annulus vent valve is set below certain depths, which is believed to be in the range of approximately 2,000 to 3,000 feet, it is no longer economically feasible to design an annulus vent valve with a power spring large enough to overcome the hydrostatic head and maintain the flapper in a closed position. The annulus vent valve of the present invention has been developed to solve this problem.

SUMMARY OF THE INVENTION

The present invention has been contemplated to overcome the foregoing deficiencies and meet the above described needs. In a broad aspect, the invention is an annulus vent valve comprising: a body member having a first end, a second end, an outer surface, a longitudinal bore adjacent the second end, and at least one flow port extending from the longitudinal bore to the outer surface; a closure member mounted within the longitudinal bore to control fluid flow therethrough; means for biasing the closure member to a normally closed position to prevent fluid flow through the longitudinal bore; a closure member actuator disposed for movement within the longitudinal bore to open and close the closure member; means for biasing the closure member actuator away from the closure member; a piston connected to the closure member actuator and having a first end and a second end; and a gas chamber disposed within the body member and in communication with the second end of the piston. Another feature of this aspect of the present invention is that the second end of the body member may be sealably connected to a well packer. Another feature of this aspect of the present invention is that the closure member may be a flapper closure. Another feature of this aspect of the present invention is that the closure member may be a ball closure. Another feature of this aspect of the present invention is that the closure member may be a plug closure. Another feature of this aspect of the present invention is that the closure member may be a poppet closure. Another feature of this aspect of the present invention is that the piston may be a rod disposed for longitudinal movement within a cylinder formed in the body member. Another feature of this aspect of the present invention is that the piston may be an annular cylinder disposed for longitudinal movement within the longitudinal bore. Another feature of this aspect of the present invention is that the piston may further include a disconnect mechanism to ensure fail-safe closure of the closure member in the event pressure within the gas chamber is lost. Another feature of this aspect of the present invention is that the first end of the piston may be in fluid communication with a control conduit connected to a source of hydraulic fluid at the earth's surface. Another feature of this aspect of the present invention is that the control conduit may include a filter for filtering debris from the hydraulic fluid. Another feature of this aspect of the present invention is that the gas chamber may be a conduit having an enclosed first end and a second end in fluid communication with the second end of the piston. Another feature of this aspect of the present invention is that the conduit may include a portion coiled about an inner support member. Another feature of this aspect of the present invention is that the body member may include a charging port in communication with the gas chamber and having a charging fitting disposed therein. Another feature of this aspect of the present invention is that the charging fitting may be a dill core valve. Another feature of this aspect of the present invention is that the gas chamber may be filled with pressurized gas. Another feature of this aspect of the present invention is that the gas chamber may be partially filled with a barrier fluid. Another feature of this aspect of the present invention is that the barrier fluid may be silicone. Another feature of this aspect of the present invention is that the gas chamber may be filled with gas at atmospheric pressure. Another feature of this aspect of the present invention is that the gas chamber may be partially filled with a barrier fluid. Another feature of this aspect of the present invention is that the barrier fluid may be silicone.

In another aspect, the present invention may be an annulus vent valve for venting accumulated production fluid from below a packer attached to a production tubing and set within a casing, an annulus being formed between the production tubing and the casing, the packer having a longitudinal bore therethrough and an upper surface, the annulus vent valve comprising: a body member having a first end, a second end, an outer surface, a longitudinal bore adjacent the second end, and at least one flow port extending from the longitudinal bore to the outer surface, the second end of the body member being sealably connected to the upper surface of the packer, the longitudinal bore in the second end of the body member being aligned with the longitudinal bore through the packer; a closure member mounted within the longitudinal bore in the second end of the body member to selectively allow fluid from below the packer to communicate with the annulus above the packer; means for biasing the closure member to a normally closed position to prevent fluid flow through the longitudinal bore; a closure member actuator disposed for movement within the longitudinal bore in the second end of the body member to open and close the closure member; means for biasing the closure member actuator away from the closure member; a piston connected to the closure member actuator and having a first end and a second end, the first end of the piston being in fluid communication with a control conduit connected to a source of hydraulic fluid at the earth's surface; and a gas chamber disposed within the body member and in communication with the second end of the piston. Another feature of this aspect of the present invention is that the gas chamber may be a conduit having an enclosed first end and a second end in fluid communication with the second end of the piston. Another feature of this aspect of the present invention is that the body member may include a charging port in communication with the gas chamber and having a charging fitting disposed therein. Another feature of this aspect of the present invention is that the gas chamber may be filled with pressurized gas. Another feature of this aspect of the present invention is that the gas chamber may be partially filled with a barrier fluid. Another feature of this aspect of the present invention is that the gas chamber may be filled with gas at atmospheric pressure. Another feature of this aspect of the present invention is that the gas chamber may be partially filled with a barrier fluid.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Figure 1:
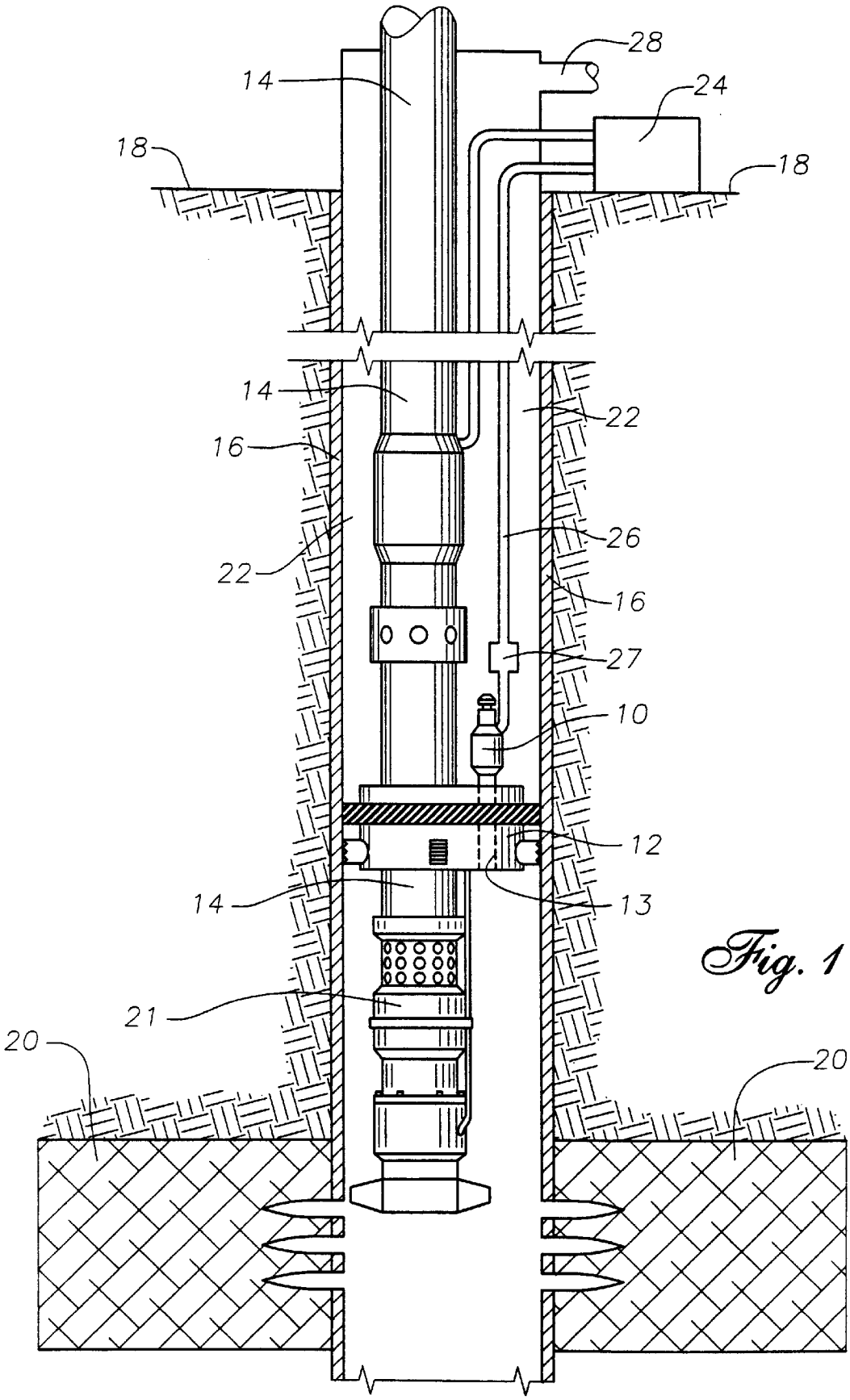
FIG. 1 illustrates a partial cross-sectional elevation view of a typical well completion including the deep-set annulus vent valve of the present invention.

Referring to the drawings in detail, wherein like numerals denote identical elements throughout the several views, there is shown in FIG. 1 a deep-set annulus vent valve 10 of the present invention that is connected to an upper surface of a packer 12 and across a longitudinal, or secondary, bore 13 through the packer 12. The packer 12 is connected to a production tubing 14 that is disposed within a casing 16, both of which extend from the earth's surface 18 to a hydrocarbon producing formation 20. An electric submersible pump 21 is connected to the tubing 14 below the packer 12. The production tubing 14 and the casing 16 define an annulus 22 therebetween. As explained above, the function of the annulus vent valve 10 is to permit the flow of gas or other production fluids that have built up below the packer 12 through the longitudinal bore 13 of the packer 12 and into the annulus 22 above the packer 12. The annulus vent valve 10 is controlled by applying hydraulic fluid from a hydraulic fluid source 24 at the earth's surface 18 through a control conduit 26 to the valve 10. When the valve 10 is actuated to permit the flow of gas or other fluids through the longitudinal bore 13 of the packer 12, the gas or other production fluids will flow upwardly through the annulus 22. The gas or other production fluids are produced at the earth's surface 18 through a production conduit 28.

The deep-set annulus vent valve 10 of the present invention will now be described. Referring initially to FIGS. 2A–2D, the annulus vent valve 10 of the present invention includes a body member 30 having a first end 32 (FIG. 2A), a second end 34 (FIG. 2D), an outer surface 36, a longitudinal bore 38 (FIGS. 2C and 2D) adjacent the second end 34, and at least one flow port 40 (FIG. 2D) extending from the longitudinal bore 38 to the outer surface 36. As shown in FIG. 2D, the valve 10 further includes a closure member 42 mounted within the longitudinal bore 38 to control fluid flow therethrough. The closure member 42 may be a flapper closure, a ball closure, a plug closure, a poppet closure, or other closure of any type well known to those of ordinary skill in the art. A spring 44 is provided for biasing the closure member 42 to a normally closed position to prevent fluid flow through the longitudinal bore 38. A closure member actuator 46 is disposed for movement within the longitudinal bore 38 to open and close the closure member 42. As shown in FIG. 2C, a power spring 48 is provided to bias the closure member actuator 46 away from the closure member 42. The valve 10 further includes a piston 50 having a first end 52 and a second end 54. The piston 50 is connected to the closure member actuator 46. In a specific embodiment, the piston 50 may be a rod disposed for longitudinal movement within a cylinder 56 formed in the body member 30. In this embodiment, the second end 54 of the piston 50 is not exposed to, and thus not upwardly biased by, production fluids when the closure member 42 is open. The piston 50 may include a mechanical "disconnect" device to ensure fail-safe closure of the closure member 42 in the event pressure within a gas chamber 60, more fully described below, is lost. Alternatively, the piston 50 may be an annular cylinder disposed for longitudinal movement within the longitudinal bore 38. Hydraulic fluid is applied to the first end 52 of the piston 50 through a control line 58, which is in turn connected to the control conduit 26 (see FIG. 1) that is connected to the source of hydraulic fluid 24 located at the earth's surface 18. In a specific embodiment, the control conduit 26 may include a filter 27 for filtering debris from the hydraulic fluid.

Figure 2A:
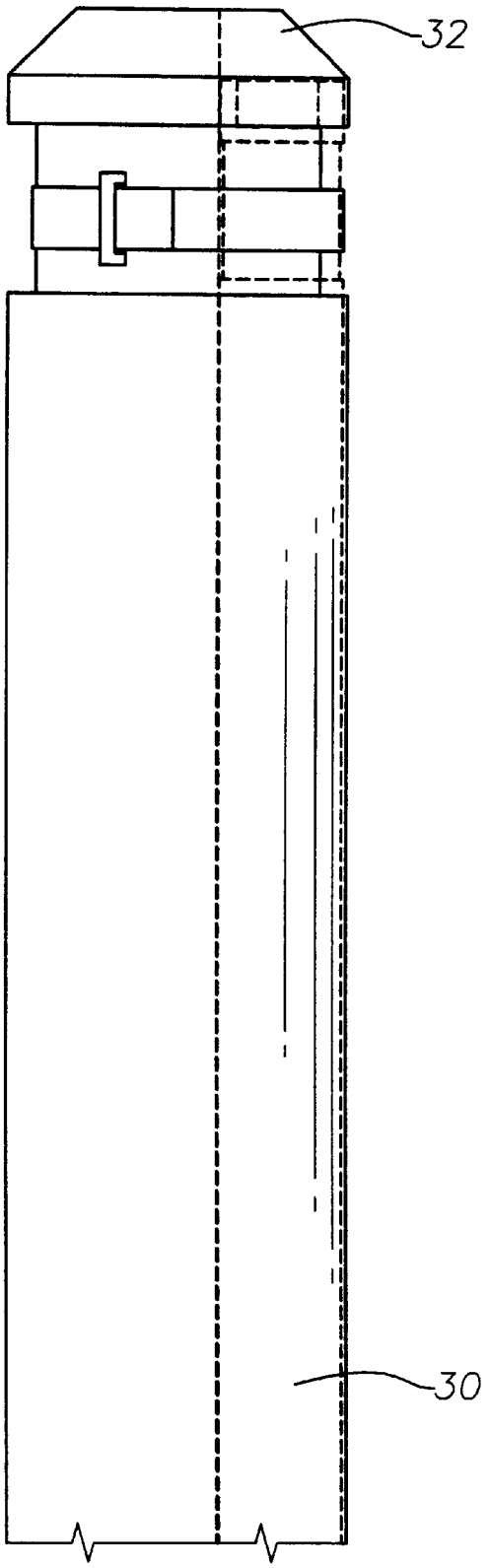
FIGS. 2A through 2D illustrate a longitudinal cross-sectional view of the deep-set annulus vent valve of the present invention.
Figure 2B:
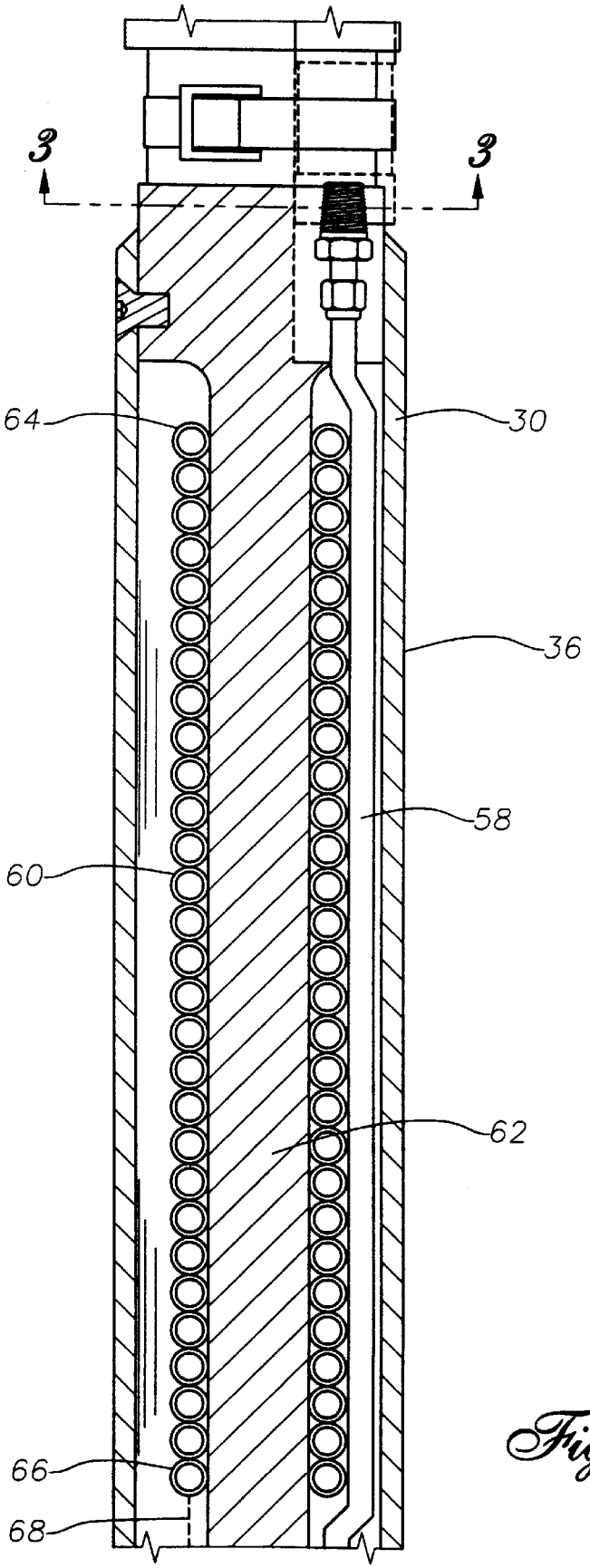
Figure 2C:
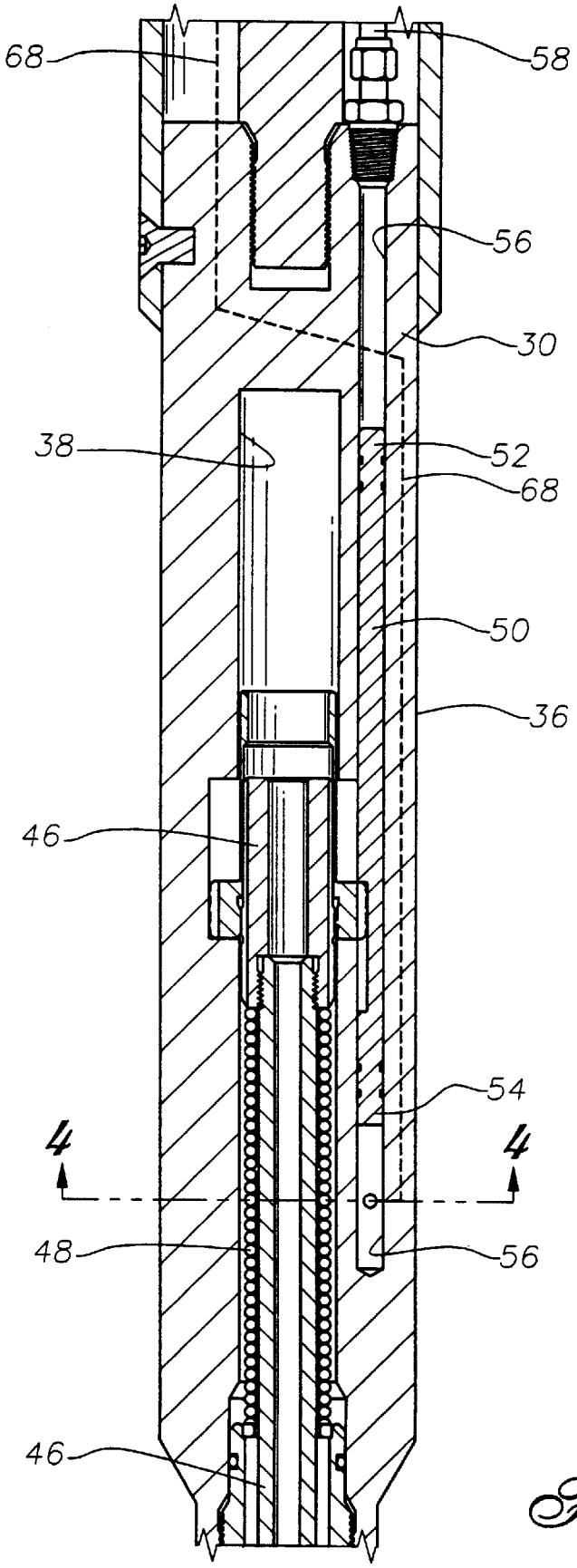
Figure 2D:
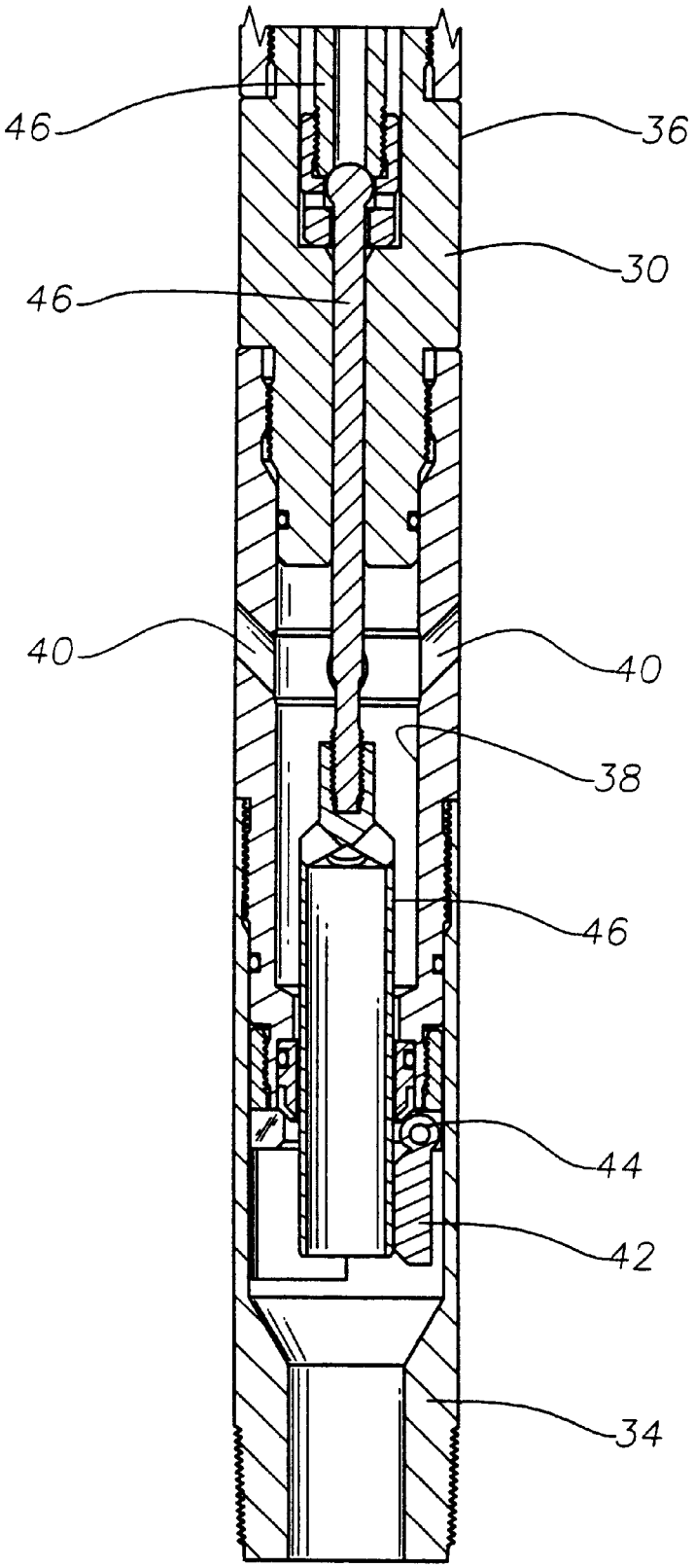
Figure 3:
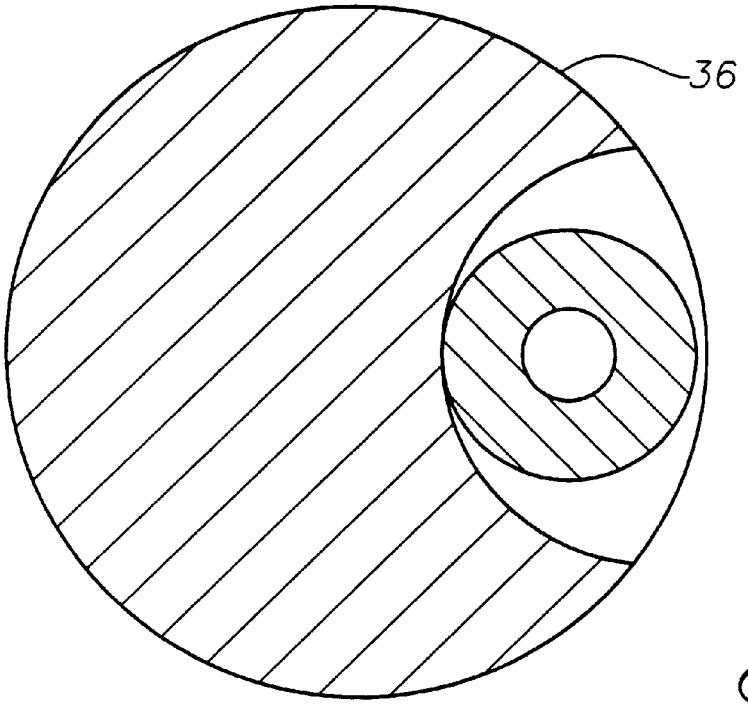
FIG. 3 is a cross-sectional view taken along line 3—3 of FIG. 2B.
Figure 4:
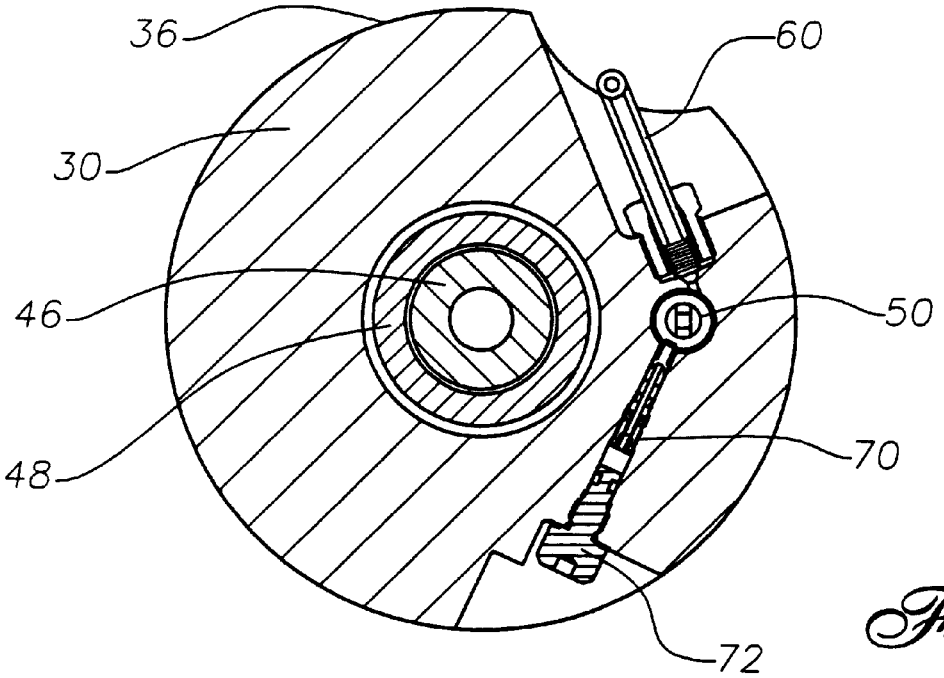
FIG. 4 is a cross-sectional view taken along line 4—4 of FIG. 2C.

Referring to FIGS. 2B and 2C, the valve 10 further includes the gas chamber 60 disposed within the body member 30 and in communication with the second end 54 of the piston 50. In a specific embodiment, the chamber 60 may be a conduit having an enclosed first end 64 and a second end 66 in fluid communication with the second end 54 of the piston 50, as indicated by dashed line 68 in FIGS. 2B and 2C, and as shown FIG. 4, which is a cross-sectional view taken along line 4—4 of FIG. 2C. As shown in FIG. 2B, in a specific embodiment, the conduit may have a portion coiled about an inner support member 62. As shown in FIG. 4, the body member 30 may include a charging port 70 in communication with the gas chamber 60 and with a charging fitting 72 disposed therein for supplying a predetermined amount of pressurized gas, liquid, or both, to the gas chamber 60. The predetermined amount of pressurized gas varies depending on the depth at which the valve 10 will be set within the casing 16 (see FIG. 1). In a specific embodiment, the gas chamber 60 may be filled with pressurized nitrogen or other suitable gas. In a specific embodiment, a barrier fluid, such as silicone or other suitable fluid, may also be inserted into the chamber 60 through the fitting 72 to enhance the operation and function of the valve 10. In a specific embodiment, the charging fitting 72 may be a dill core valve. In a specific embodiment, the gas chamber 60 may be filled with gas at atmospheric pressure.

With reference to FIG. 1, the valve 10 is connected to the upper surface of the packer 12 such that the longitudinal bore 38 in the body member 30 of the valve 10 is aligned with the longitudinal bore 13 through the packer 12. Before setting the well completion in place as shown in FIG. 1, the gas chamber 60 may be precharged to the desired pressure, depending on the depth at which the valve 10 is to be set. The gas chamber 60 is typically precharged with sufficient pressure to balance the greater of the hydrostatic head in the control conduit 26 or the annulus pressure so that the power spring 48 is capable of biasing the closure member 42 to its closed position. The reason the annulus pressure should be considered is because it is possible that the control conduit 26 could develop a leak, in which case the first end 52 of the piston 50 would become exposed to the annulus pressure. Thus, if the annulus pressure is greater than the hydrostatic head, the gas chamber 60 should be precharged with sufficient force to balance the annulus pressure. However, other pressures may be used. Once the valve 10 is set in place, as shown in FIG. 1, and when it becomes desired to vent gas or other production fluids from below the packer 12, the valve 10 is actuated by applying hydraulic fluid through the control conduit 26 to the piston 50 to move the closure member actuator 46 and thereby move the closure member 42 to its open position. Gas or other well fluid below the packer 12 is then allowed to flow from the longitudinal bore 13 in the packer 12 through the longitudinal bore 38 in the valve 10, through the at least one flow port 40 (see FIG. 2D) in the valve 10, into the annulus 22 above the packer 12, and to the earth's surface 18.

It can now be seen from the foregoing description that the annulus vent valve 10 of the present invention solves the problem associated with the use of previous annulus vent valves at greater depths than heretofore used. More particularly, by providing the valve 10 of the present invention with the gas chamber 60 to communicate a force to the second end 54 of the piston 50, the force of the hydrostatic head within the control conduit 26 that is acting on the first end 52 of the piston 50 is offset so that it is possible to provide the valve 10 with a power spring 48 having sufficient force to bias the closure member 42 to its closed position, even at great depths such as those encountered in the deep waters of the Gulf of Mexico.

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

We claim:

1. An annulus vent valve comprising:

a body member having a first end, a second end, an outer surface, a longitudinal bore adjacent the second end, and at least one flow port extending from the longitudinal bore to the outer surface;

a closure member mounted within the longitudinal bore to control fluid flow therethrough;

means for biasing the closure member to a normally closed position to prevent fluid flow through the longitudinal bore;

a closure member actuator disposed for movement within the longitudinal bore to open and close the closure member;

means for biasing the closure member actuator away from the closure member;

a piston connected to the closure member actuator and having a first end and a second end; and, a gas chamber disposed within the body member and in communication with the second end of the piston.

2. The annulus vent valve of claim 1, wherein the second end of the body member is sealably connected to a well packer.

3. The annulus vent valve of claim 1, wherein the closure member is a flapper closure.

4. The annulus vent valve of claim 1, wherein the closure member is a ball closure.

5. The annulus vent valve of claim 1, wherein the closure member is a plug closure.

6. The annulus vent valve of claim 1, wherein the closure member is a poppet closure.

7. The annulus vent valve of claim 1, wherein the piston is a rod disposed for longitudinal movement within a cylinder formed in the body member.

8. The annulus vent valve of claim 1, wherein the first end of the piston is in fluid communication with a control conduit connected to a source of hydraulic fluid at the earth's surface.

9. The annulus vent valve of claim 8, wherein the control conduit includes a filter for filtering debris from the hydraulic fluid.

10. The annulus vent valve of claim 1, wherein the gas chamber is a conduit having an enclosed first end and a second end in fluid communication with the second end of the piston.

11. The annulus vent valve of claim 10, wherein the conduit includes a portion coiled about an inner support member.

12. The annulus vent valve of claim 1, wherein the body member includes a charging port in communication with the gas chamber and having a charging fitting disposed therein.

13. The annulus vent valve of claim 12, wherein the charging fitting is a dill core valve.

14. The annulus vent valve of claim 1, wherein the gas chamber is filled with pressurized gas.

15. The annulus vent valve of claim 14, wherein the gas chamber is partially filled with a barrier fluid.

16. The annulus vent valve of claim 15, wherein the barrier fluid is silicone.

17. The annulus vent valve of claim 1, wherein the gas chamber is filled with gas at atmospheric pressure.

18. The annulus vent valve of claim 17, wherein the gas chamber is partially filled with a barrier fluid.

19. The annulus vent of claim 18, wherein the barrier fluid is silicone.

20. An annulus vent valve for venting accumulated production fluid from below a packer attached to a production tubing and set within a casing, an annulus being formed between the production tubing and the casing, the packer having a longitudinal bore therethrough and an upper surface, the annulus vent valve comprising:

a body member having a first end, a second end, an outer surface, a longitudinal bore adjacent the second end, and at least one flow port extending from the longitudinal bore to the outer surface, the second end of the body member being sealably connected to the upper surface of the packer, the longitudinal bore in the second end of the body member being aligned with the longitudinal bore through the packer;

a closure member mounted within the longitudinal bore in the second end of the body member to selectively allow fluid from below the packer to communicate with the annulus above the packer;

means for biasing the closure member to a normally closed position to prevent fluid flow through the longitudinal bore;

a closure member actuator disposed for movement within the longitudinal bore in the second end of the body member to open and close the closure member;

means for biasing the closure member actuator away from the closure member;

a piston connected to the closure member actuator and having a first end and a second end, the first end of the piston being in fluid communication with a control conduit connected to a source of hydraulic fluid at the earth's surface; and a gas chamber disposed within the body member and in communication with the second end of the piston.

21. The annulus vent valve of claim 20, wherein the gas chamber is a conduit having an enclosed first end and a second end in fluid communication with the second end of the piston.

22. The annulus vent valve of claim 20, wherein the body member includes a charging port in communication with the gas chamber and having a charging fitting disposed therein.

23. The annulus vent valve of claim 20, wherein the gas chamber is filled with pressurized gas.

24. The annulus vent valve of claim 23, wherein the gas chamber is partially filled with a barrier fluid.

25. The annulus vent valve of claim 20, wherein the gas chamber is filled with gas at atmospheric pressure.

26. The annulus vent valve of claim 25, wherein the gas chamber is partially filled with a barrier fluid.

* * * * *